United States Patent [19]

Stanislaw

[11] 4,010,522

[45] Mar. 8, 1977

[54] APPARATUS FOR DRYING WEB-LIKE MATERIAL

[75] Inventor: Peter Stanislaw, Stockholm, N.J.

[73] Assignee: Morrison Machine Co., Paterson, N.J.

[22] Filed: Dec. 29, 1975

[21] Appl. No.: 644,726

Related U.S. Application Data

[63] Continuation of Ser. No. 424,778, Dec. 14, 1973, abandoned.

[52] U.S. Cl. ..... 26/18.6

[51] Int. Cl.[2] ..... D06C 21/00

[58] Field of Search ..... 34/108, 109, 113–122, 34/48, 49, 52, 55; 26/18.5, 18.6; 226/195, 44; 68/5 D, 19.1

[56] References Cited

UNITED STATES PATENTS

| | | | |
|---|---|---|---|
| 3,277,552 | 10/1966 | Pandell | 26/18.6 |
| 3,339,249 | 9/1967 | Libby | 26/18.6 |
| 3,691,600 | 9/1972 | Joy | 26/18.6 |

FOREIGN PATENTS OR APPLICATIONS

| | | | |
|---|---|---|---|
| 552,287 | 11/1956 | Italy | 226/44 |

*Primary Examiner*—Kenneth W. Sprague
*Assistant Examiner*—James C. Yeung
*Attorney, Agent, or Firm*—Lerner, David, Littenberg & Samuel

[57] ABSTRACT

Apparatus is disclosed for drying web-like material, such as knit material, being fed to a pre-shrinking machine such as a compressor. The apparatus includes a frame, at least one drying roller about which the web-like material passes in traveling from a first station to a second station, motive means for rotating the drying roller, and adjustable tension responsive control means controlling the speed and direction of operation of said motive means in response to the tension in the web-like material. The invention is particularly applicable in the situation where a pair of webs of different material are being processed by a single compressor and the necessity exists for accurately controlling the tension existing on both webs of material as it is applied to the compressor. In addition, a novel moisture applying unit is disclosed.

7 Claims, 2 Drawing Figures

10
12
14
16
18
20
22
24
26
28
30
32
34
36
38
40
42
44
46
48
50
52
54
56
58
60
62
64
66
68
70
72
74
76
80
82
84
86
88
90
92

APPARATUS FOR DRYING WEB-LIKE MATERIAL

This is a continuation of application Ser. No. 424,778, Dec. 14, 1973, now abandoned.

FIELD OF THE INVENTION

This invention relates to apparatus for drying web-like material, more particularly relates to apparatus for pre-drying material, such as knit material, which is to be subsequently processed by a pre-shrinking compressor, and even more particularly relates to such apparatus which includes means for accurately controlling the tension applied to such material. In addition, this invention relates to a novel moisture applying unit.

BACKGROUND OF THE INVENTION

In the art of pre-shrinking textile materials, it is known to pass the material to be treated between a pair of endless belts, commonly referred to as blankets. The blankets are typically constructed of rubber or rubber-like material, with each such blanket being guided by a plurality of rollers. Means are employed to properly tension the blankets such that the blankets compress the fibers of the textile material passing therebetween toward one another to thereby pre-shrink the textile material and thus diminish possible shrinkage which might otherwise occur during subsequent washing. One such process known in the industry which employs such apparatus is known as the Sanforizing process.

As in other processes involving the handling of textile materials, it would normally be desirable in handling materials being processed by a compressor to pre-dry the fabric (to eliminate unknown amounts of moisture accumulated during previous handling and storage of the material) and then add predetermined and uniform moisture prior to passing the material into the compressor. Typical pre-drying schemes employ a series of conventional drying rollers, known as drying cans, about which the material passes before being further processed. Unfortunately, when the material passes around such drying cans, the material is subjected to unwanted tension which has the effect of stretching the fibers in imprecise and uncontrollable amounts thereby deleteriously affecting the ability of the compressor to precisely pre-shrink the material by controlling the fiber spacing. This problem is especially acute with today's popular knit materials.

Another problem experienced with compressing apparatus for textiles and related to control of the tension of the material passing therethrough, stems from the desirability, from an increased production point of view, of processing more than one stand of web-like material through the compressor simultaneously. Unfortunately, since different materials have been knit or woven with different degrees of tightness, it is not possible to have a single compressor process two different materials and end up with the proper degree of pre-shrinkage for each.

Another problem encountered relates to the problem of applying uniform moisture without the undesirable accumulation of water droplets which is frequently encountered.

SUMMARY OF THE INVENTION

The instant invention comprises apparatus for drying web-like material passing therethrough and includes at least one motor driven drying roller about which the web-like material passes in traveling between first and second stations but, in addition, includes adjustable tension responsive control means for controlling the speed and direction of rotation of the drying roller in response to the tension in web-like material passing thereabout. In this manner, the amount of tension introduced into the material by the pre-drying apparatus can be precisely regulated such that such tension controlled material can be most effectively processed by compressing apparatus of the type described above.

As a further feature of the invention, the ability of the pre-drying apparatus hereof to precisely control the amount of tension introduced into the material passing therethrough enables the use of two of such pre-drying units in a tandem side by side fashion to feed a single compressor thereby doubling its efficiency. For example, if two different materials, having been knit with different degrees of tightness, are to be processed by a single compressor which is to have the same pre-shrinking effect on both webs of material, the degree of tension introduced by one of the pre-drying units may be varied with respect to the degree of tension introduced by the other of the pre-drying units so that the two materials enter the compressor with the same characteristics. Alternatively, it may be desirable to pre-shrink certain lengths of the same material with different degrees of tightness. In the instant invention, this can be accomplished by running two strands of the same material through side by side pre-dryers of the instant invention while varying the degree of tension introduced by each unit. In this manner, the two strands of material being introduced into the compressor will have different degrees of tightness prior to the time that the compressor affects the fibers thereof with the end result being that the pre-shrinking will vary for each strand of material. The possibilities are endless, depending upon the amount of tension introduced in each of the pre-drying units prior to the time that the material passing through each is fed to the common compressor.

As a further feature of the invention, a novel moisture applying unit is provided in which the web of material passing therethrough experiences an angular path of travel. In this manner, and as will be further disclosed, undesirable accumulations of water are prevented.

Accordingly, it is an object of the instant invention to provide apparatus for drying web-like material with the apparatus including at least one motor driven drying roller about which the web of material passes in traveling between first and second stations and adjustable tension responsive control means for controlling the speed and direction of rotation of said drying roller in response to the tension in the web-like material thereby permitting the controlled regulation of tension introduced into such material.

Another object of the instant invention is to provide such apparatus for pre-drying web-like material usable in tandem side by side relationship by means of which two webs of material can be tension controlled in such a manner as to facilitate pre-shrinking thereof by a common compressor.

Still another object of the instant invention is to provide a novel moisture applying unit in which the web of material passing therethrough experiences an angular path of travel.

Other objects of the invention will become apparent upon reading the following specification, in conjunction with the following drawings.

DETAILED DESCRIPTION

Figure 1:
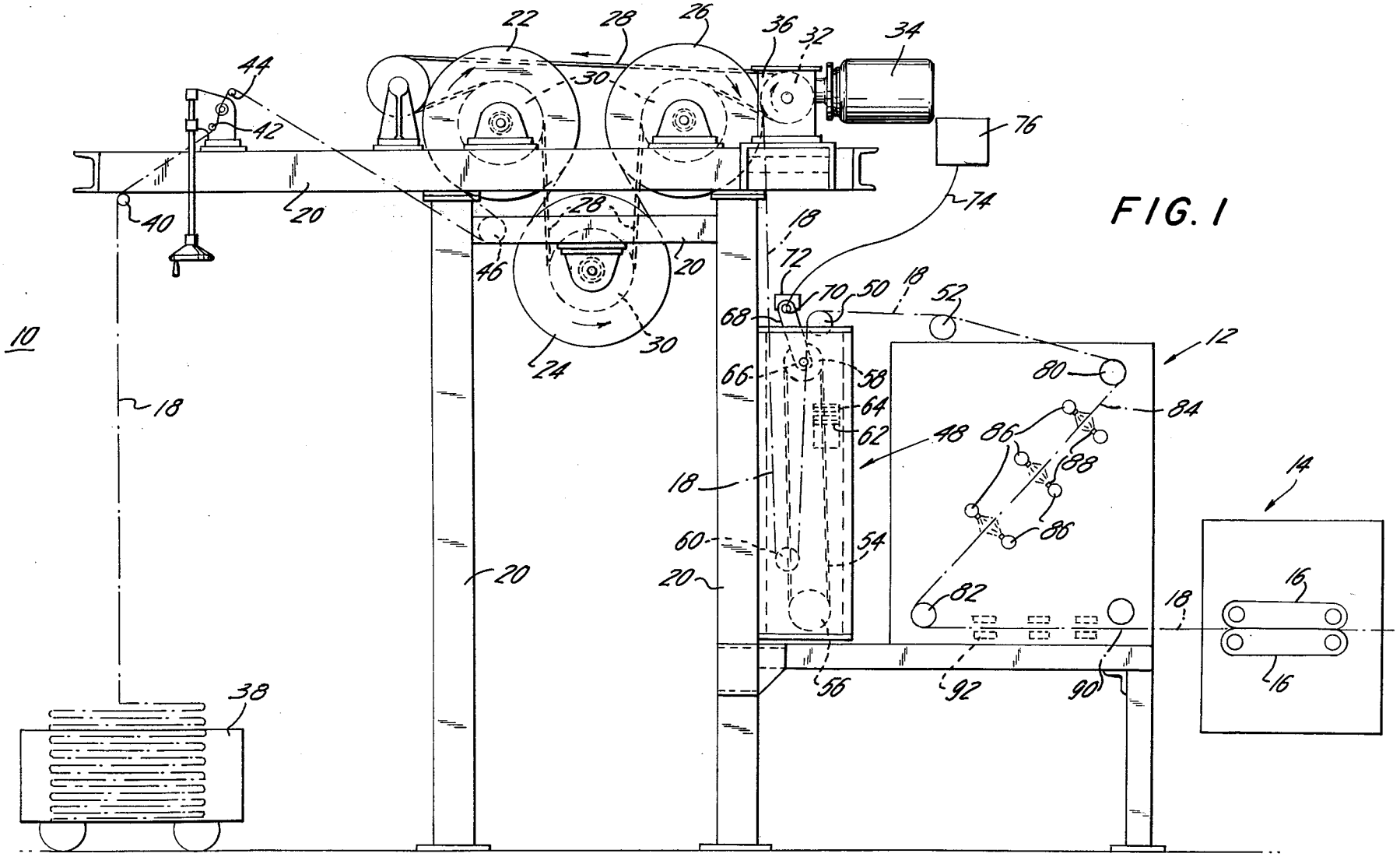
FIG. 1 is a side elevational view of apparatus constructed in accordance with the instant invention and further illustrating the path of flow of material through such apparatus on its way to being introduced into a compressor.

Turning to the drawings, where like numerals designate corresponding elements, there is shown in FIG. 1 the drying apparatus 10 of the instant invention which, as noted previously, is primarily intended for pre-drying webs of textile-like materials so as to eliminate moisture accumulated therein during previous handling and storage thereof. In addition to the drying apparatus 10, there is also schematically shown in FIG. 1 a novel moisture applying unit 12, to be described in greater detail, by which regulated and controlled amounts of moisture may be added to the pre-dried material prior to the time that the material is fed to a compressor 14 which includes a pair of endless blankets 16 between which the web of material 18 is fed to pre-shrink same in accordance with known techniques. Although not to be limited hereby, it is noted that the compressor 14 may be of the type disclosed and claimed in U.S. Pat. application Ser. No. 409,052, filed Oct. 24, 1973, in the name of Kreeft, et al, and assigned to the assignee of the present invention.

The drying apparatus 10 includes a frame comprised of structs 20 on which are journaled for rotation a plurality of conventional drying cans 22, 24 and 26. Drying cans 22, 24 and 26 are driven by a belt drive 28 which passes around pulleys 30 associated with each of the drying cans so as to effect the desired rotation of the drying cans in response to the rotation of a drive pulley 32 actuated by a DC motor 34 through a speed reducing right angle gear box 36.

The flow of the material 18 is from the supply truck 38 around rollers 40, 42,44, 46 over drying can 22, around the lower drying can 24, up over the last drying can 26, through an adjustable tension responsive control system 48 (to be described in greater detail), over rollers 50 and 52, through the moisture applying unit 12 ad into the compressor 14.

The adjustable tension responsive control system 49 includes an endless belt 54 carried about a pair of freely rotatable pulleys 56 and 58. Secured to one side of the endless belt 54 but freely rotatable with respect thereto is a guide pulley 60 about which the web of material 18 passes to reverse its diection of travel. Secured to the other side of the belt 54 is a weight 62 which can be made heavier or lighter by adding or substracting small weight increments 64 thereto. Upper pulley 58 carries a sprocket 66, and an endless chain 68 communicates rotation of the sprocket 66 (in response to rotation of the pulley 58) to a sprocket 70 which mechanically controls a conventional potentiometer 72 to produce variable signals on the line 74 being applied to a control box 76 for the DC motor 34. The control box 76 affects the speed and direction of operation of the DC motor 34 is accordance with the signal produced on the line 74 dependent, of course, upon the direction and amount of mechanical motion sensed by the potentiometer 72. It should be noted that a control system for a DC motor which controls the speed in both directions is commonly known in the industry as a regenerative drive system and the control unit 76 therefor is a standard purchased item, such as the control unit manufactured by Wer Electric of Grand Island, New York.

In operation, the magnitude of the weight 62 is chosen relative to the weight of the pulley 60 so that the belt 54 is in a state of equilibrium and the web of material 18 has a pre-selected amount of tension applied thereto. As the material 18 passes over the drying cans 22, 24 and 26, any increased tension in the material 18 will affect the aforedescribed equilibrium causing the pulley 60 to rise and the belt 54 to travel clockwise about the upper pulley 58. Rotation of the pulley 58 causes corresponding rotation of the sprocket 66 and the chain 68 communicates such rotation to the potentiometer 72 thereby applying appropriate electrical signal on the line 74 to the control box 76 which will affect the speed of rotation of the DC motor 34 to increase the speed of delivery of the material 18 over the drying cans 26 and thereby provide sufficient enough "slack" to relieve the aforedescribed increase in tension. With too much slack in the material 18, the pulley 60 will drop and the belt 54 will travel counterclockwise about the upper pulley 58 imparting similarly directed rotation to the potentiometer 72, which in turn through the control box 76 affects the speed and direction of the rotation of DC motor 34 so as to "take up" the undesirable slack. The end result is that the sensing system, including the pulleys and endless belt 54, together with the transducer (potentiometer 72) functions as a following servo system which maintains the tension in the material 18 at a predetermined controlled tension by which the material 18 can be processed by the compressor 14. As noted previously, prior to the instant invention, the uncontrollable amount of tension introduced into textile materials with the use of a pre-drying apparatus employing drying cans, limited the ability of a compressor to accurately pre-shrink the material, especially where knit materials are being processed.

Figure 2:
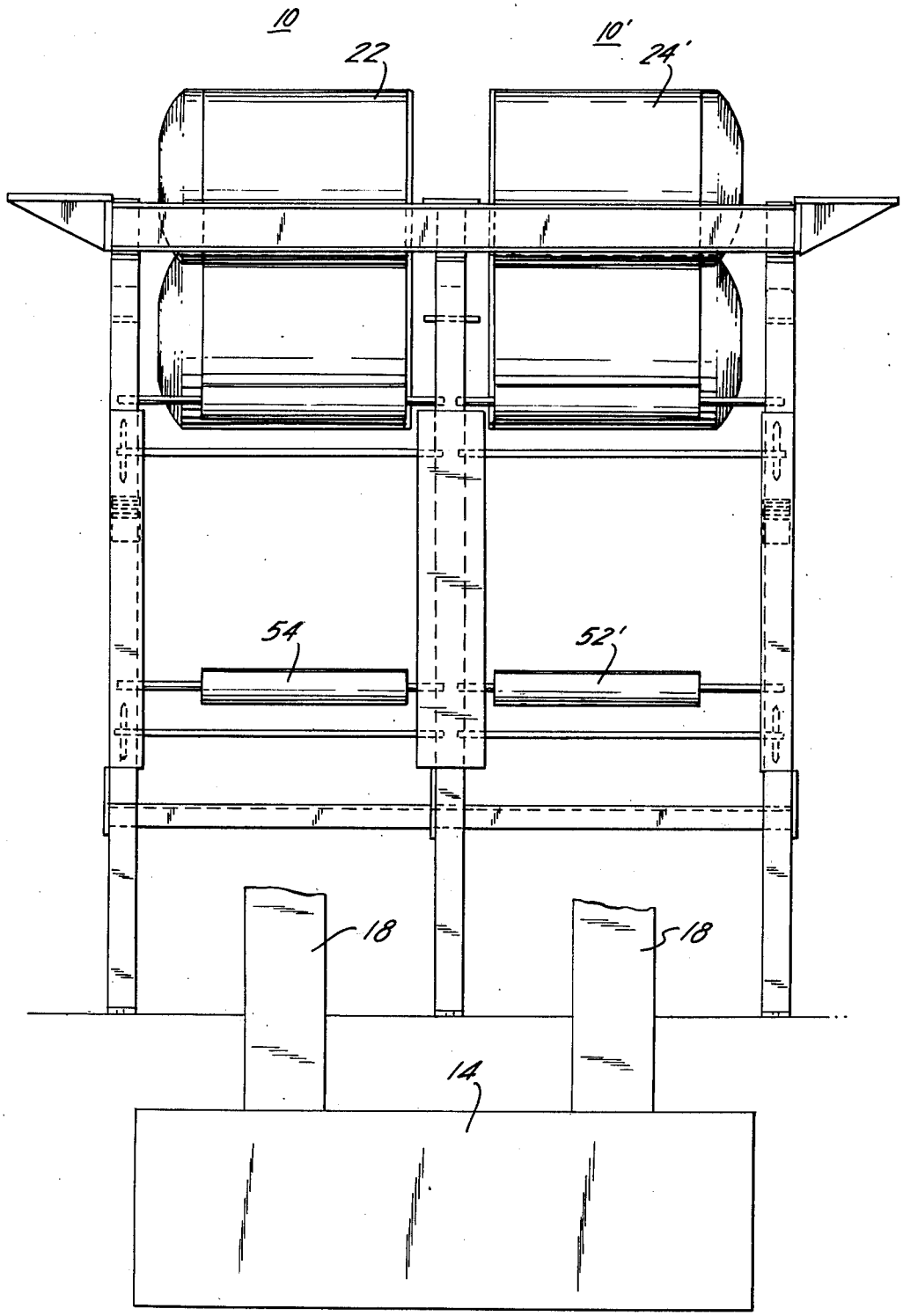
FIG. 2 is a plane view of a portion of the apparatus showing FIG. 1 and illustrating the side by side orientation of a pair of pre-drying units of the instant invention as they would be situated for processing two strands of material being fed to the single compressor illustrated in FIG. 1.

As also suggested previously, the present invention also facilitates the economic utilization of a compressor for dual strands of web-like material. In FIG. 2, drying units 10 and 10', identical in all respects to the drying unit 10 described with respect to FIG. 1, are placed in side by side tandem fashion, and their respective webs of material 18 and 18' are processed and re-shrunk by a single compressor 14. As suggested previously, even if webs 18 and 18' are of differing materials, the respective adjustable tension responsive control systems 48 and 48' can be regulated with respect to one another to achieve the desired tension characteristics for the webs of material before they enter the compressor 14. This arrangement wherein a single compressor can advantageously operate on a pair of strands is indeed made possible by virtue of the independent tension control which can be applied to each of such strands.

The moisture applying unit 12 comprises an enclosure 78 having rollers 80 and 82 disposed as indicated such that the material 18 will experience an angular path of travel therebetween. On opposite sides of that portion 84 of the material 18 which passes between the rollers 80 and 82 are a plurality of water pipes 86 having spaced apart nozzles 88 therealong. On opposite sides of portion 90 of the material 18 are a plurality of slotted steam pipes 92 by which steam can be introduced to the material 18. In operation, water droplets are sprayed through the nozzles 88 to the material 18. By virtue of the angular path of travel of the material 84, any droplets of water which are not absorbed by the material 18 fall vertically downward onto the lowermost portion of the portion 90 of the material 18. In the prior art, where the portion of the material such as 84 normally experiences a vertical path of travel, there has been an undesirable puddle of water which tends to accumulate in the vicinity of the downwardly directed material and the roller 82. The angular path of travel established by the novel moisture applying unit totally eliminates such problem.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. Apparatus for pre-shrinking first and second webs of material, including a compressor, first feeding means for feeding the first web of material into the compressor, second feeding means being arranged side-by-side to said first feeding means for feeding the second web of material into the compressor alongside said first web of material while the first feeding means is feeding the first web of material into the compressor, a first adjustable tension responsive control system for maintaining a first predetermined tension on the first web of material as it enters the compressor, and a second adjustable tension responsive control system being arranged side-by-side to said first adjustable tension responsive control system for maintaining a second predetermined tension on the second web of material as it enters the compressor to compensate for the differing characteristics of said first and second webs of material so that they enter said compressor with controlled tension characteristics and are each preshrunk to the desired extent in said compressor.

2. Apparatus according to claim 1, wherein said compressor comprises a pair of endless blankets between which the first and second webs of material are fed, the tension of each such web being controlled as it enters between such belts by said first and second adjustable tension responsive control systems, respectively.

3. Apparatus according to claim 2, wherein each of said first and second adjustable tension responsive control systems includes mechanical-to-electrical servo means for maintaining its respective web of material at its respective predetermined tension.

4. Apparatus according to claim 3, wherein said servo system includes a mechanical-to-electrical transducer adapted to generate a variable electrical control signal in response to a predetermined mechanical movement, and sensing means responsive to changes in tension in each web for applying proportionate mechanical movement to its respective transducer, said sensing means being adapted to sense the tension in its respective web.

5. Apparatus according to claim 4, wherein each said sensing means includes a pair of guide pulleys, an endless belt passing around said guide pulleys, a third guide pulley rotatably carried by said endless belt, the respective web passing around said third guide pulley, adjustable weight means carried by said endless belt, and communication means communicating movement of said endless belt to said transducer.

6. Apparatus according to claim 5, wherein said first feeding means and said second feeding means each includes at least one drying roller.

7. In combination:

a material compressor comprising a pair of endless belts between which said material passes to be preshrunk; and apparatus for drying material before it is fed to said compressor; said apparatus comprising:

a frame, first and second drying rollers about which first and second webs of material pass in traveling from a first station to a second station, first motive means for rotating said first drying roller, second motive means for rotating said second drying roller, first adjustable tension responsive control means for controlling the speed and direction of operation of said first motive means in response to tension in said first web of material; and second adjustable tension responsive control means for controlling the speed and direction of operation of said second motive means in response to tension in said second web of material.

* * * * *

UNITED STATES PATENT OFFICE

CERTIFICATE OF CORRECTION

Patent No. 4,010,522 Dated March 8, 1977

Inventor(s) Peter Stanislaw

It is certified that error appears in the above-identified patent and that said Letters Patent are hereby corrected as shown below:

Column 3, line 51, the word "ad" should read -- and --.
Column 3, line 52, the numeral "49" should read -- 48 --.
Column 4, line 52, the word "re-shrunk" should read -- pre-shrunk --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*